US008893692B2

(12) United States Patent
Brandes et al.

(10) Patent No.: US 8,893,692 B2
(45) Date of Patent: Nov. 25, 2014

(54) IGNITION METHOD AND IGNITION SYSTEM THEREFOR

(75) Inventors: André Brandes, Hannover (DE); Rainer Voelz, Winsen/Aller (DE)

(73) Assignee: MOTORTECH GmbH, Celle (DE)

( * ) Notice: Subject to any disclaimer, the term of this patent is extended or adjusted under 35 U.S.C. 154(b) by 227 days.

(21) Appl. No.: 13/579,650

(22) PCT Filed: Mar. 16, 2011

(86) PCT No.: PCT/DE2011/075043

§ 371 (c)(1),
(2), (4) Date: Aug. 17, 2012

(87) PCT Pub. No.: WO2011/113431

PCT Pub. Date: Sep. 22, 2011

(65) Prior Publication Data

US 2012/0325190 A1 Dec. 27, 2012

(30) Foreign Application Priority Data

Mar. 17, 2010 (DE) ..... 10 2010 015 998

(51) Int. Cl.
*F02P 3/05* (2006.01)
*F02P 17/12* (2006.01)
*F02P 3/055* (2006.01)

(52) U.S. Cl.
CPC *F02P 17/12* (2013.01); *F02P 3/053* (2013.01)
USPC ..... 123/644

(58) Field of Classification Search
USPC ..... 123/644, 609, 652, 656; 324/380
See application file for complete search history.

(56) References Cited

U.S. PATENT DOCUMENTS

| | | | | | |
|---|---|---|---|---|---|
| 4,174,696 | A | * | 11/1979 | Jundt et al. | 123/644 |
| 4,228,779 | A | * | 10/1980 | Wetzel | 123/652 |
| 4,469,082 | A | * | 9/1984 | Nishitoba et al. | 123/609 |
| 4,658,788 | A | * | 4/1987 | Yamamoto et al. | 123/406.54 |
| 4,977,883 | A | | 12/1990 | Koiwa | |
| 4,998,526 | A | * | 3/1991 | Gokhale | 123/598 |
| 5,060,623 | A | * | 10/1991 | McCoy | 123/605 |
| 5,723,916 | A | | 3/1998 | Disney et al. | |
| 7,401,603 | B1 | | 7/2008 | Lepley | |
| 2003/0089356 | A1 | * | 5/2003 | Schmied et al. | 123/644 |
| 2008/0202485 | A1 | * | 8/2008 | Garrard | 123/644 |

FOREIGN PATENT DOCUMENTS

| | | | |
|---|---|---|---|
| DE | 4008540 | A1 | 9/1990 |
| EP | 0555851 | A2 | 8/1993 |
| EP | 0808024 | A2 | 11/1997 |
| EP | 1103720 | A2 | 5/2001 |
| WO | 2009040299 | A1 | 4/2009 |

* cited by examiner

*Primary Examiner* — Mahmoud Gimie
(74) *Attorney, Agent, or Firm* — Patent Central LLC; Stephan A. Pendorf

(57) ABSTRACT

An ignition system and method for internal combustion engines with which a reliable triggering of an ignition spark is provided with control of the ignition process over the entire firing duration, wherein an excessive stress on the ignition coil and spark plug is avoided. By detecting the primary current and evaluating it in a control loop, the state of the secondary circuit can be detected reliably. In the case of a disturbance, for example at strongly spent spark plug, the ignition current is immediately readjusted via the control circuit in order to avoid a disruption in spark. This ignition current control thus reacts automatically to sources of defect on the secondary side current.

9 Claims, 4 Drawing Sheets

IGNITION METHOD AND IGNITION SYSTEM THEREFOR

Figure 1:
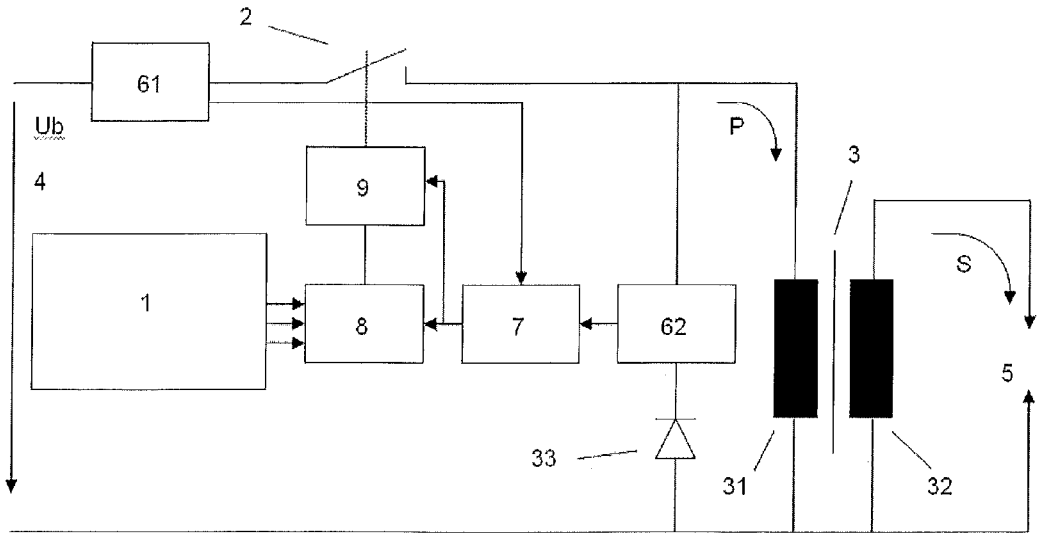

The invention relates to an ignition method for internal combustion engines having an ignition coil, with a primary circuit and a secondary circuit, and a spark plug arranged in the secondary circuit, wherein the ignition current is a pulse signal which is controlled by pulse-width modulation in the primary circuit. Further, the invention relates to an ignition system for internal combustion engines with a control unit for providing a control signal, a firing (spark duration) time and an ignition current, an electronic switch for generating a pulse signal, an ignition coil with primary and secondary winding, wherein the primary winding is connected via the electronic switch to a voltage source and the secondary winding supplies the spark plug.

In spark-ignition internal combustion engines, an ignition system for ignition of the fuel-air mixture in the combustion chamber by means of ignition spark is required. Modern spark-ignition internal combustion engines typically use an electronic ignition system with an ignition coil for energy storage. In order to achieve an optimum ignition while on the other hand not overstressing the ignition coil or the spark plug, a situational-dependent setting of the ignition energy required for each ignition process is crucial.

In the prior art, various methods for controlling the ignition energy are known. In a pulse-width modulated firing control, the ignition current or the ignition energy is controlled by software stored in a CPU. Here, the ignition coil is driven with pulses of variable width. From EP 1 103 720 B1 a method and apparatus for power control of an ignition system for an internal combustion engine is known, in which electrical energy is stored in a magnetic field that has been built up by a primary current, and the magnetic field collapses by interrupting the primary current and generated a high voltage by induction, which is used for ignition, wherein a control signal provides an intended or setpoint value for the primary current and, by current regulation, limits the primary current to this intended value, wherein for current control, after reaching the desired value of the primary current, the current flow from the battery to a primary winding is switched on and off. This method makes it possible to keep the magnetization of an ignition coil constant for a certain time, in order then to produce an ignition spark at the desired time. For current regulation, a pulse-width modulation is used, the method operating on the basis of the blocking oscillator type converter or flyback converter operation and receives as the actual value the signal of a secondary ion current measurement.

Accordingly, with the known pulse-width modulated ignition control devices a pulse chain is used to adjust the firing time of the ignition spark. The generation of the switching pulses by the CPU, however, has the disadvantage of a relatively low switching frequency, whereby a high ripple current is produced. Due to the lack of feedback about the actual condition of the current, a monitoring of the optimal functioning of the ignition can not be carried out. For example, a spark interruption is not recognized, so that no countermeasures can be taken. In order to avoid interruptions in spark, in the prior art a higher ignition energy than is really necessary is supplied, which leads to an increased erosion of the spark plug electrodes.

As a further ignition control, a pulse string ignition is known, which is similar to the pulse-width-modulated firing control, however, it intentionally produces a spark interruption. The ignition coil is demagnetized between pulses, resulting in a defined spark break. In the next pulse the ignition spark is then built up again. This mode is particularly suitable for mixtures that require relatively low ignition energy. An ignition method switchable between a pulse string ignition and a single pulse ignition is known from EP 1 299 630 B1.

Further, as a third electronic ignition system, an AC voltage ignition is known in which the primary circuit of the ignition coil is supplied with an alternating voltage.

For this, a resonant circuit comprising ignition coil and capacitor is driven, wherein at the output a high voltage of alternating polarity is present, and wherein spark plugs correspondingly matched thereto have to be used.

The problem of adequate energy supply and/or firing duration are described for example in documents EP 0489264 B1 and DE 101 55 972 A1. A scheme for control of the ignition current is not disclosed therein.

The object of the invention is to provide an ignition system and an ignition method, with which a reliable triggering of an ignition spark is provided with control of the ignition process over the entire firing duration, wherein an excessive stress on the ignition coil and spark plug is avoided.

This object is achieved with an ignition method according to claim 1 and an ignition system according to claim 6.

According to the invention, the basic idea is to use the ignition coil as a current transformer or transmitter. By detecting the primary current and evaluating it in a control loop, the state of the secondary circuit can be detected reliably. In the case of a disturbance, for example at strongly spent spark plug, the ignition current is immediately readjusted via the control circuit in order to avoid a disruption in spark. This ignition current control thus reacts automatically to sources of defect on the secondary side current. Each cylinder, or each spark plug, is thus supplied with the individual optimal ignition current. By measuring the current, the condition of the sparkplug is continuously monitored and in case of fault is compensatingly regulated. Here, the coil in operation acts as a forward or flow-through converter. The conformation of the ignition current to the target current is based on pulse width modulation or frequency modulation or pulse width and frequency modulation. In the case of frequency modulation, special characteristics of each ignition coil as well as other parameters of the control response can be considered.

By measuring the actual instantaneous flyback current induced in the coil, and combining the instantaneous primary current and the instantaneous flyback current to obtain a total current, and comparing the total current with the specified target ignition current, it becomes possible by measuring flyback current that this control loop can be used for several ignition coil/spark plug systems of multi-cylinder internal combustion engines. Here, a primary current is measured prior to the distribution of the primary current to the ignition coils associated with the respective cylinders or spark plugs, i.e., before the electronic switches which are arranged parallel to one another. The current measurement is carried out sequentially, first for the respectively connected primary current and immediately thereafter for each flowing flyback current induced in the associated ignition coil. The flyback current is measured with the second current measuring means at the interconnect node of the flyback diodes. By detection and summation of the respective primary current and the associated flyback current, a reliable basis for comparison against the specified target ignition current is then present that can be compared in the comparator and can be utilized for controlling the primary current by a pulse width modulation and/or a frequency modulation.

If the energy supplied to the ignition coil it is determined by integrating of the total current, and if upon reaching a maximum energy the power supply to the ignition coil is interrupted, an overloading the ignition coil and/or spark plug is avoided in the case of a defect. Here, the maximum energy is selected so that the usual wear and tear, particularly at the spark plug, is within a tolerance range that is determined by the maximum energy. If, however, a significant defect occurs in the secondary circuit, such as the ignition coil or the spark plug, and thus the maximum power is exceeded for an ignition, the ignition is interrupted to avoid overstressing the components. In terms of the device, this is achieved in that an integrator is provided, which receives the signal of the total current from the adder and is integrated to an ignition energy, wherein, on reaching a maximum energy supplied to the ignition coil, the electronic switch opens.

By superimposing a ramp-shaped signal on the primary circuit during the spark duration (firing) period of the spark plug, a drop of the secondary current over a long spark duration time of the spark plug is prevented. With regard to the device, this is achieved in that a secondary current correction means is connected on the primary side to the control unit and the comparator, wherein the secondary current correction means emits, controlled by the control unit, a ramp-shaped signal during the firing period of the spark plug. The control unit controls the secondary current correction means as well as the steepness of the ramp. The steepness of the ramp can be preset differently depending on the type of ignition pulse. Depending to the respectively associated type of ignition pulse, the correct ramp can then be selected by the configuration of the control unit. In the secondary current means, the ramp is generated such that it runs during the firing period of the spark plug and, by the rising ramp-shaped signal, prevents the otherwise resulting secondary current drop.

If the start ignition current up to spark-over is not regulated, then the charging of the ignition coil is carried out with a fixed predetermined charging current, and the current regulation takes place only after the spark-over.

If the pulse signal has a fixed or controlled switching frequency of 50 kHz and higher, in particular 50 kHz to 100 kHz, then in spite of the regulation a very straightforward ignition current progression can be achieved, which avoids current peaks. In particular, the ripple current, known in pulse-width modulated ignition control, is avoided.

Figure 2:
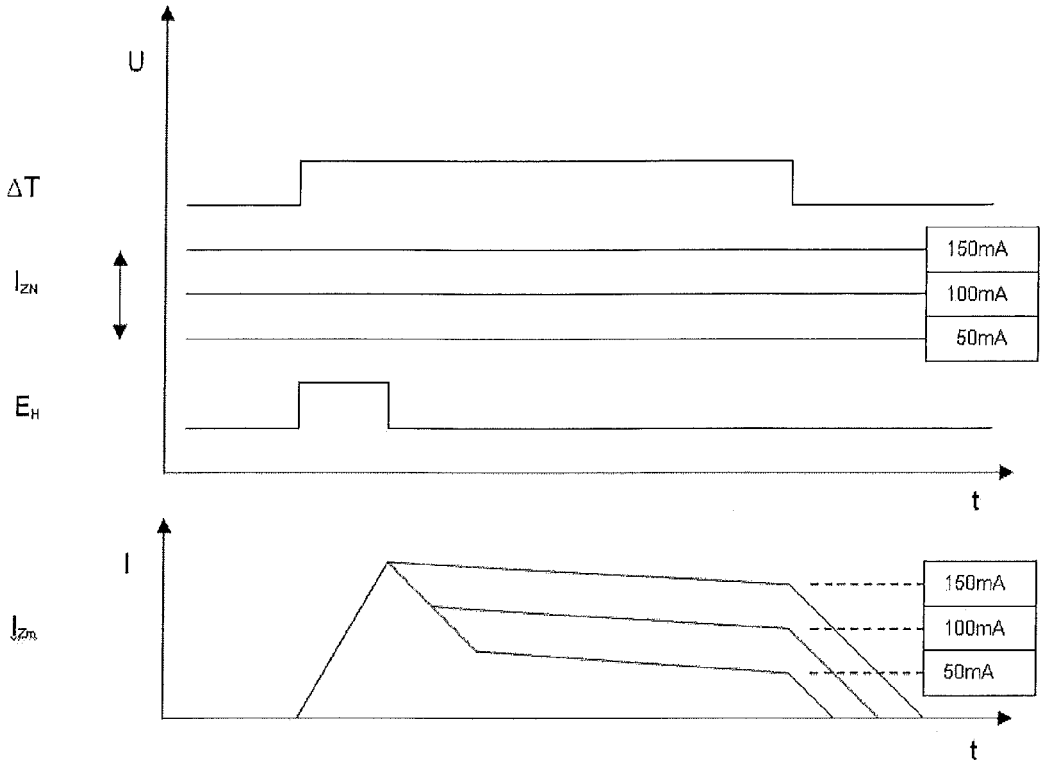
Figure 3:
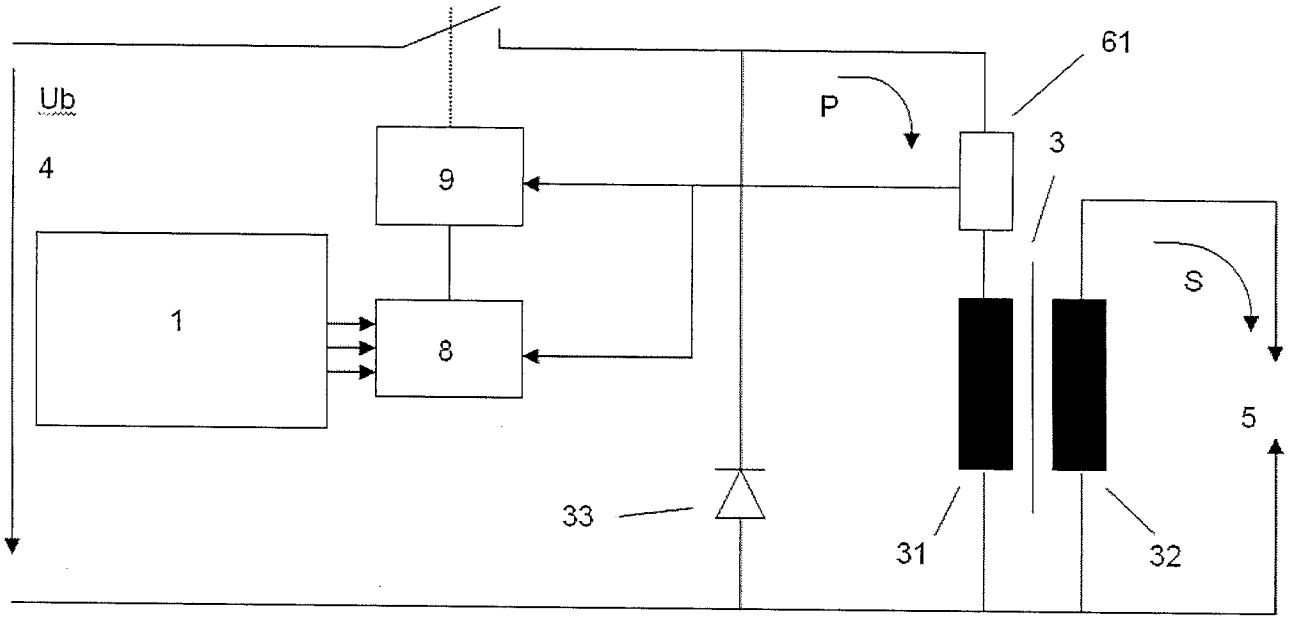
Figure 4:
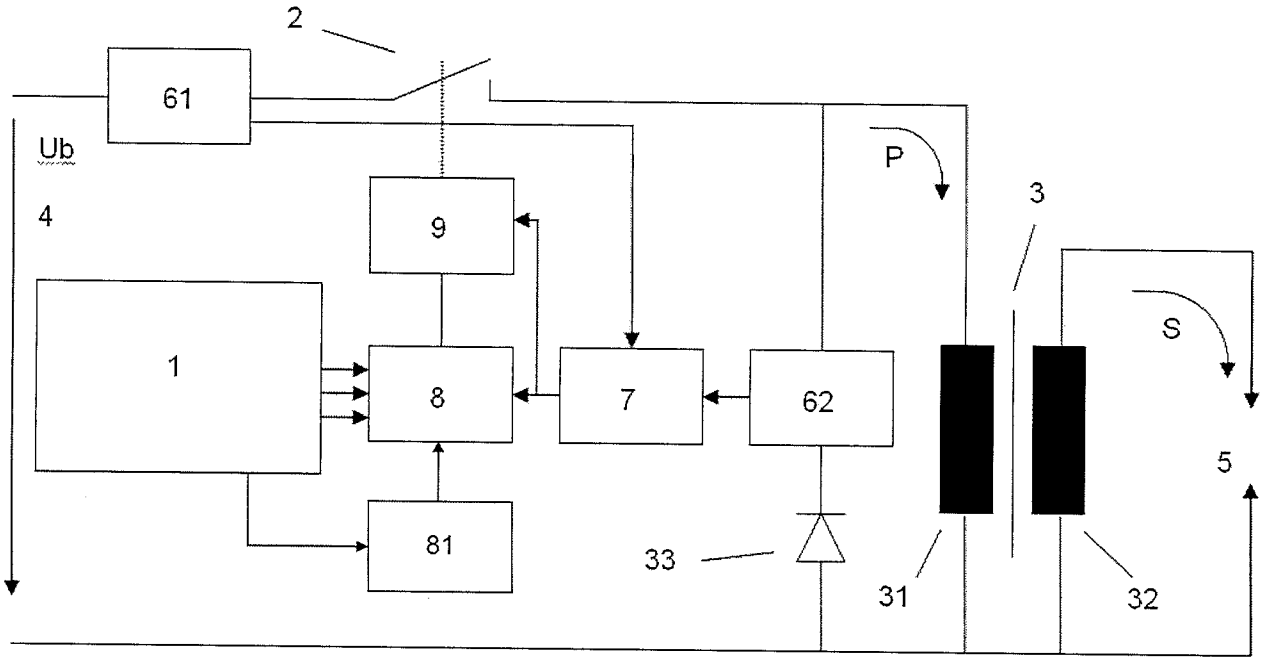

An embodiment is described with reference to the accompanying drawings:

Therein there is shown in:

FIG. 1 a schematic of the principle of the circuit of the inventive ignition system, FIG. 2 two graphs depicting the progress of the control and current signals in the inventive ignition system, FIG. 3 a schematic of the principle of a simplified embodiment of the invention, and FIG. 4 a circuit principle in accordance with FIG. 1 with secondary flow correction.

FIG. 1 shows a basic circuit of the ignition system according to the invention. The circuit comprises a control unit 1, which is for example a CPU, in which the parameters for the operation of the ignition system and associated software is stored. Essential parameters include the setting of the drive signal, the setting of the firing duration, and the setting of the ignition current. Further, the control unit 1 predetermines the initiating current with charge time, and thereby the high voltage supply.

The circuit further comprises an electronic switch 2 in the primary circuit P supplied by a voltage source 4. The primary circuit P extends over primary winding 31 of the ignition coil 3. Further, a flyback diode 33 is connected in the primary circuit P in parallel to the primary winding 31 of the ignition coil 3. A first current measuring means 61 is provided the primary circuit P for determining the actual flowing primary current. Further, in the line with the flyback diode 33 parallel to the primary winding 31 there is arranged a second current measuring means 62 for measuring the flyback current.

The ignition coil 3 has, in addition to the primary winding 31, a secondary winding 32 (high voltage part), which forms, together with a spark plug 5, a secondary circuit S.

The two measuring signals of the first current measuring means 61 and the second current measuring means 62 are provided to an adder 7, which determines from the two signals the total current. The total current is applied to a comparator 8, which compares the total current with the preset ignition current set in the control unit 1. According to the comparison in the comparator 8, the electronic switch 2 is controlled so that the target current set the control unit 1 is achieved. Here, the current in the primary circuit P is changed by pulse width modulation and/or frequency modulation.

In the illustrated embodiment, the total current signal from the adder 7 is also sent to an integrator 9, which integrates the respective actual measured total current from an ignition process and thus determines the ignition energy. If the ignition energy exceeds a predetermined maximum energy set in the control unit 1, the electronic switch 2 is opened, thus interrupting the ignition. Thereby an overstressing of the components, in particular the ignition coil 3 and the spark plug 5, is avoided.

In FIG. 2 two graphs are shown. The upper graph shows the control signals preset in the control unit 1, in particular firing duration ΔT, ignition current $I_{Zv}$, and high voltage supply $E_H$ over time t. In the lower graph the ignition current $I_{ZM}$ supplied to the ignition coil 3 according to the control of the control unit 1 over time t is shown.

From FIG. 2 it can be seen that over the desired firing duration ΔT, a variable, but fixed for a particular ignition system, predetermined ignition current $I_{Zv}$, for example 100 mA (center line), can be maintained relatively constant by regulating. From the start of the firing period ΔT (rise of the signal), the high-voltage supply-$E_H$ is established in the ignition coil 3 and maintained by the fixed predetermined charging energy up to the descending ramp of the high voltage supply $E_H$. In this period of time an ionization of the spark gap and an arcing occurs (sparking). With termination of the high voltage supply $E_H$ (falling edge), regulation begins, and the ignition current is adjusted to the predetermined 100 mA based on the control loop comprising the adder 7, comparator 8, electronic control unit 1 and switch 2. Due to the high switching frequency of the pulse signal of, for example, 50 kHz to 100 kHz, a steady and substantially linear ignition current flow is achieved up to the end of the firing time DT (falling edge).

The embodiment according to FIG. 1 is advantageous in particular for internal combustion engines having a plurality of spark plugs (multiple cylinders), since only one control loop is required if the ignition coils assigned to each spark plug are connected in parallel via respective electronic switch 2 to the first current measuring means 61. Accordingly, it is essential for this circuit that the first current measuring means is arranged before the branching to the electronic switches 2. Accordingly, the flyback diodes 33 associated the respective ignition coils are grouped together via a knot at their base, at which the flyback current is then measured sequentially with a second current measuring means 62.

In FIG. 3 a simplified embodiment is shown illustrating the switching principle. In this case, only the primary current is measured with a first current measuring means 61 and compared via a comparator 8 with a predetermined desired current set in control unit 1, so that the ignition current is regulated accordingly. In this circuit, comprising one control loop for each ignition coil/spark plug unit, a flyback current measurement is not required.

FIG. 4 shows a block diagram of the inventive ignition system as shown in FIG. 1, and further including a secondary current correction. Since the circuit otherwise corresponds with that shown in FIG. 1, reference is made to the character description for FIG. 1. The reference numbers are chosen accordingly. In FIG. 4 however additionally a secondary current correction means 81 is provided, which acts on the control 8 in such a manner that a ramp-like rising signal generated in the correction means 81 is superimposed upon the control loop. The control unit 1 triggers the ramp-shaped signal produced in the secondary current correction means 81, wherein the control unit 1 also transmits the steepness of the ramp by means of secondary correction factor. Therein the secondary correction factor, i.e., the slope of the ramp, takes into consideration the ignition pulse type in the circuit. With the secondary current correction means 81 it is thus possible to compensate for the drop of the secondary current in the case of a long firing time of the spark plug 5 by ramp-like rising signal superimposed on the control circuit. The quality of the ignition process over the entire firing duration is thus further improved.

LIST OF REFERENCE NUMERALS

1 control unit
2 electronic switch
3 coil
31 primary winding
32 secondary winding
33 flyback diode
4 voltage source
5 spark plug
61 first current measuring means
62 second current measuring means
7 adder
8 comparator; regulator
81 secondary flow correction means
9 integrator
P primary circuit
S secondary circuit

The invention claimed is:

1. A method for ignition for internal combustion engines with an ignition coil (3) with the primary circuit (P) and secondary circuit (S) and a spark plug (5) provided in the secondary circuit (S), wherein the ignition current is a pulse signal which is controlled by pulse width modulation in the primary circuit (P), wherein the method comprises:

measuring the primary current actually in the primary current circuit (P), comparing the measured primary current with a predetermined target current, and readjusting the pulse width modulation and/or a frequency modulation of the pulse signal in the primary circuit (P) based on the comparison result, in order to achieve the desired current, and wherein an instantaneous flyback current induced in the ignition coil (3) is measured, and the instantaneous primary current and the instantaneous flyback current are added to give a total current, and the total current is compared with the predetermined target ignition current.

2. The method according to claim 1, wherein a ramp-shaped rising signal is superimposed on the primary circuit during the firing period of the spark plug.

3. The method according to claim 1, wherein the initial ignition current is not controlled until ignition sparking.

4. A method for ignition for internal combustion engines with an ignition coil (3) with the primary circuit (P) and secondary circuit (S) and a spark plug (5) provided in the secondary circuit (S), wherein the ignition current is a pulse signal which is controlled by pulse width modulation in the primary circuit (P), wherein the method comprises:

measuring the primary current actually in the primary current circuit (P), comparing the measured primary current with a predetermined target current, and readjusting the pulse width modulation and/or a frequency modulation of the pulse signal in the primary circuit (P) based on the comparison result, in order to achieve the desired current, and wherein by integration of the total current the total energy supplied to the ignition coil (3) is determined and on reaching a maximum energy the supply of current to the ignition coil (3) is interrupted.

5. An ignition system for internal combustion engines, with a control unit (1) providing a drive signal, a firing time and an ignition current, an electronic switch (2) for generating a pulse signal, an ignition coil (3) with primary (31) winding and secondary winding (32), wherein said primary winding (31) is connected to a voltage source (4) via the electronic switch (2), and the secondary winding (32) feeds a spark plug (5), and a first current measuring means (61) for determining the primary current flowing through the primary winding (31), to which a comparator (8) is associated downstream for comparison with the target current predetermined by the control unit (1), which is operatively associated with the electronic switch (2) for pulse width and/or frequency modulation of the primary current and thus of the ignition current amplitude, wherein a second current measuring means (62) is provided for determining the flyback current induced in the primary winding (31), and an adder (7) is provided for adding the currents measured with current measuring means (61, 62) to the total current, wherein the total current is applied to the comparator (8).

6. The ignition system according to claim 5, wherein the pulse signal has a fixed or controlled switching frequency of 50 kHz and higher.

7. The ignition system according to claim 5, wherein the pulse signal has a fixed or controlled switching frequency of 50 kHz to 100 kHz.

8. An ignition system for internal combustion engines, with a control unit (1) providing a drive signal, a firing time and an ignition current, an electronic switch (2) for generating a pulse signal, an ignition coil (3) with primary (31) winding and secondary winding (32), wherein said primary winding (31) is connected to a voltage source (4) via the electronic switch (2), and the secondary winding (32) feeds a spark plug (5), and a first current measuring means (61) for determining the primary current flowing through the primary winding (31), to which a comparator (8) is associated downstream for comparison with the target current predetermined by the control unit (1), which is operatively associated with the electronic switch (2) for pulse width and/or frequency modulation of the primary current and thus of the ignition current amplitude, wherein an integrator (9) is provided, which receives the signal of the total current from the adder (7) and is integrated to an ignition energy, whereby upon reaching an energy maximum fed to one of the ignition coils (3), the electronic switch (2) opens.

9. An ignition system for internal combustion engines, with a control unit (1) providing a drive signal, a firing time and an ignition current, an electronic switch (2) for generating a pulse signal, an ignition coil (3) with primary (31) winding and secondary winding (32), wherein said primary winding (31) is connected to a voltage source (4) via the electronic switch (2), and the secondary winding (32) feeds a spark plug (5), and a first current measuring means (61) for determining the primary current flowing through the primary winding (31), to which a comparator (8) is associated downstream for comparison with the target current predetermined by the control unit (1), which is operatively associated with the electronic switch (2) for pulse width and/or frequency modulation of the primary current and thus of the ignition current amplitude, wherein a secondary current correction means (81) is connected on the primary side to the control unit (1) and the comparator (8), wherein the secondary current correction means (81), under control of the control unit (1), provides a ramp-like rising signal during the firing period of the spark plug.

* * * * *